US005892327A

United States Patent [19]

Buij et al.

[11] Patent Number: 5,892,327

[45] Date of Patent: Apr. 6, 1999

[54] CIRCUIT ARRANGEMENT FOR OPERATING A DISCHARGE LAMP

[75] Inventors: Arnold W. Buij; Johannes H. Wessels; Ronny A. A. M. Jacobs, all of Eindhoven, Netherlands

[73] Assignee: U.S. Philips Corporation, New York, N.Y.

[21] Appl. No.: 808,595

[22] Filed: Feb. 28, 1997

[30] Foreign Application Priority Data

Apr. 6, 1996 [EP] European Pat. Off. ..... 96200978

[51] Int. Cl.[6] ..... H05B 41/00

[52] U.S. Cl. ..... 315/209 R; 315/DIG. 5; 315/219; 315/227 R

[58] Field of Search ..... 315/307, 291, 315/DIG. 5, 209 R, 227 R, 219, 248

[56] References Cited

U.S. PATENT DOCUMENTS 4,684,851 8/1987 Van Meurs ..... 315/224

4,748,383 5/1988 Houkes ..... 315/248

5,387,848 2/1995 Wong ..... 315/224

*Primary Examiner*—Arnold Kinkead

*Attorney, Agent, or Firm*—Edward Blocker

[57] ABSTRACT

A circuit arrangement according to the invention for operating a discharge lamp (I) comprises a DC/AC converter (II) provided with a series circuit with a first and a second switching element, (1, 1', respectively) between a first and a second input terminal (5, 5', respectively) for connection to a DC voltage source, and with a starting circuit (F) with a first resistive means (R1) between the first input terminal (5) and the control electrode (2) of the first switching element (1). The DC/AC converter is also provided with a second resistive element (R2) which together with the first resistive element (R1) form a voltage divider between the input terminals (5, 5'). The power dissipation in the DC/AC converter is reduced thereby.

12 Claims, 2 Drawing Sheets

CIRCUIT ARRANGEMENT FOR OPERATING A DISCHARGE LAMP

BACKGROUND OF THE INVENTION

The invention relates to a circuit arrangement for operating a discharge lamp, comprising a DC/AC converter provided with:

- a series arrangement of a first and a second switching element between a first and a second input terminal for connection to a DC voltage source, which switching elements each have a control electrode and a main electrode,
- a load branch with at least a primary winding of a transformer, inductive means, and output terminals for connecting the lamp, a first end of said load branch being connected to a junction point situated in the series arrangement and a second end to an input terminal,
- a first and a second secondary winding of the transformer between the control electrode of the first switching element and the main electrode of the second switching element,
- a starting circuit with first resistive means between the first input terminal and the control electrode of the first switching element, and with first capacitive means connected in series with the first secondary winding between the control electrode and the main electrode of the first switching element.

Such a circuit arrangement is known from U.S. Pat. No. 4,748,383. The starter circuit initiates an oscillation of the DC/AC converter after switching-on of the circuit arrangement.

The secondary windings of the transformer each have a comparatively large number of turns compared with the primary winding, and a series arrangement of two zener diodes connected in mutually opposed directions and having a comparatively low breakdown voltage is included between the control electrode and the main electrode of each switching element. The voltage between the control electrode and the main electrode, called control voltage hereinafter, as a result has a substantially square-wave characteristic. The switching time which elapses between the moment the control voltage has a zero passage and the moment the control voltage exceeds the threshold voltage, i.e. the voltage at which the switching element becomes conductive is short as a result. It is realized thereby that the switching elements are in the conductive state for approximately the same duration.

It is a disadvantage in the known circuit arrangement that comparatively much power is dissipated in the zener diodes which limit the control voltage of the switching elements. Not only does this detract from the efficiency of the switching arrangement, but the accompanying heat generation also hampers a miniaturization of the circuit arrangement. If the secondary windings of the coil have comparatively few turns, the control voltage need not be limited, so that zener diodes may be omitted or serve as a protection only during lamp ignition. The power dissipation in the zener diodes is negligibly small then. The gradient of the control voltage, however, is much more gradual then. Comparatively small differences in the threshold voltage of the switching elements may then lead to comparatively major differences in the time of conduction, i.e. the duration of the conductive state. The result of this is that the power dissipation in the switching elements increases.

OBJECTS AND SUMMARY OF THE INVENTION

It is an object of the invention to provide a measure which renders possible a reduction in the power dissipation in a circuit arrangement of the kind described in the opening paragraph.

According to the invention, the circuit arrangement of the kind described in the opening paragraph is for this purpose characterized in that the DC/AC converter is in addition provided with second resistive means which together with the first resistive means form a voltage divider between the input terminals. The voltage divider maintains the average value of the voltage at the control electrode at a reference level and achieves a reduction in differences in time of conduction between the switching elements.

If the first switching element in the circuit arrangement according to the invention has, for example, a lower threshold voltage than the second switching element, the first switching element will initially have a longer period of conduction. The average value of the voltage in point (P) where the load branch has its first end in the series arrangement of switching elements will be higher than in the case of equal threshold voltages. Since the average value of the voltage at the control electrode is maintained at said reference level, the average value of the control voltage is lower. The time interval during which the control voltage of the first switching element exceeds the threshold voltage decreases as a result until the switching elements have approximately the same conduction periods. In the circuit arrangement according to the invention, therefore, the starting circuit not only initiates an oscillation but also achieves a more symmetrical operation of the DC/AC converter, so that switching losses are limited.

It is noted that U.S. Pat. No 4,684,851 discloses a circuit arrangement which is provided with means for promoting a symmetrical operation of the DC/AC converter. The means in the circuit arrangement known from U.S. Pat. No. 4,684,851 are formed by a comparatively large number of components, among which a circuit element. The starting circuit, which functions independently of said means, comprises a breakdown element.

In the circuit arrangement according to the invention, the second resistive means preferably have a resistance value which lies between 4/5 and 6/5 of the resistance value of the first resistive means. Deviations in the duration of the conductive states of the switching elements then amount to at most approximately 10% of half the duration of an oscillation cycle.

The DC/AC converter of the circuit arrangement according to the invention may be, for example, a full bridge circuit in which the load branch comprises a first additional switching element, a main electrode of said switching element forms the second end of the load branch, and the first additional switching element together with a second additional switching element forms an additional series circuit between the input terminals.

Alternatively, the DC/AC converter of the circuit arrangement may be, for example, an incomplete half bridge circuit with a single branch of two switching elements between the input terminals, while decoupling capacitive means are included in the load branch.

In yet another embodiment, the DC/AC converter is a full half bridge circuit where the load branch has decoupling capacitive means which comprise a first decoupling capacitive impedance of which one side forms the second end of the load branch and which together with a second decoupling capacitive impedance forms an additional series arrangement between the input terminals.

Decoupling capacitive means may be present also in a full bridge circuit in the load branch in order to safeguard that the net charge displacement through the load branch is equal to zero. This is of importance for metal vapor discharge lamps such as low-pressure mercury discharge lamps for avoiding migration of metal in the lamp.

The switching elements are usually shunted by freewheel diodes for protection. The freewheel diodes may be integral with the switching elements.

The decoupling capacitive means are charged after switching-on of the circuit arrangement. The average voltage at point P rises as a result from zero to the value obtaining at nominal operation. This leads to a current through the load branch in the period between switching-on and nominal operation of the DC/AC converter having not only a component varying with the oscillation frequency of the circuit but also a component which always keeps the same direction and gradually decreases to zero. This may result in the direction of the current through the load branch remaining the same during the first oscillation cycles. With the first switching element in the non-conducting state, the current will then flow through the freewheel diode of the second switching element. A recovery interval of the freewheel diode occurs when the current through the load branch reverses. The freewheel diode is then temporarily conducting in its reverse direction. This leads to a peak current through the switching elements the moment the first switching elements becomes conducting during the recovery interval of the freewheel diode of the second switching element. A too high peak current value may damage the switching elements. To limit the peak current value to an acceptable level, it is necessary to choose the capacitive value of the decoupling capacitive means to be comparatively low. This, however, renders the circuit arrangement less suitable for operation at comparatively low frequencies, for example frequencies below 100 kHz. It may occur in that case that the decoupling capacitive means have already become charged before the oscillation has started.

A favorable embodiment of the circuit arrangement according to the invention is characterized in that the DC/AC voltage is in addition provided with means for offering a voltage pulse between the control electrode and the main electrode of the second switching element after switching-on of the circuit arrangement so as to have said switching element temporarily assume a conductive state.

After switching-on of the circuit arrangement but before the start of the oscillation, the current passed by the first switching elements can flow off partly through the second switching element, so that the decoupling capacitive means are charged less quickly. Sufficient time is available then for starting the oscillation, also in the case of a low oscillation frequency.

A practical implementation of this embodiment is characterized in that the means for offering the voltage pulse comprise second and third capacitive means as well as third and fourth resistive means, the second capacitive means being included in series with the second secondary winding of the transformer between the control electrode and a main electrode of the second switching element, while the third and fourth resistive means form a series circuit between the control electrode and said main electrode of the second switching element, a common junction point of said resistive means being connected to the first input terminal via the third capacitive means.

There are various possibilities for coupling the primary winding of the transformer to the other components of the load branch. The primary winding of the transformer, may, for example, form a first sub-circuit which is shunted by a second sub-circuit formed by the other components of the load branch. Alternatively, the primary winding may, for example, shunt exclusively the output terminals. A preferred embodiment of the circuit arrangement according to the invention, however, is one which is characterized in that the primary winding of the transformer is connected in series with the output terminals. The operation of the converter in this embodiment is substantially independent of the operational temperature of the lamp.

BRIEF DESCRIPTION OF THE DRAWING

These and other aspects of the invention will be explained in more detail with reference to the drawing, in which.

DESCRIPTION OF THE PREFERRED EMBODIMENTS

Figure 1:
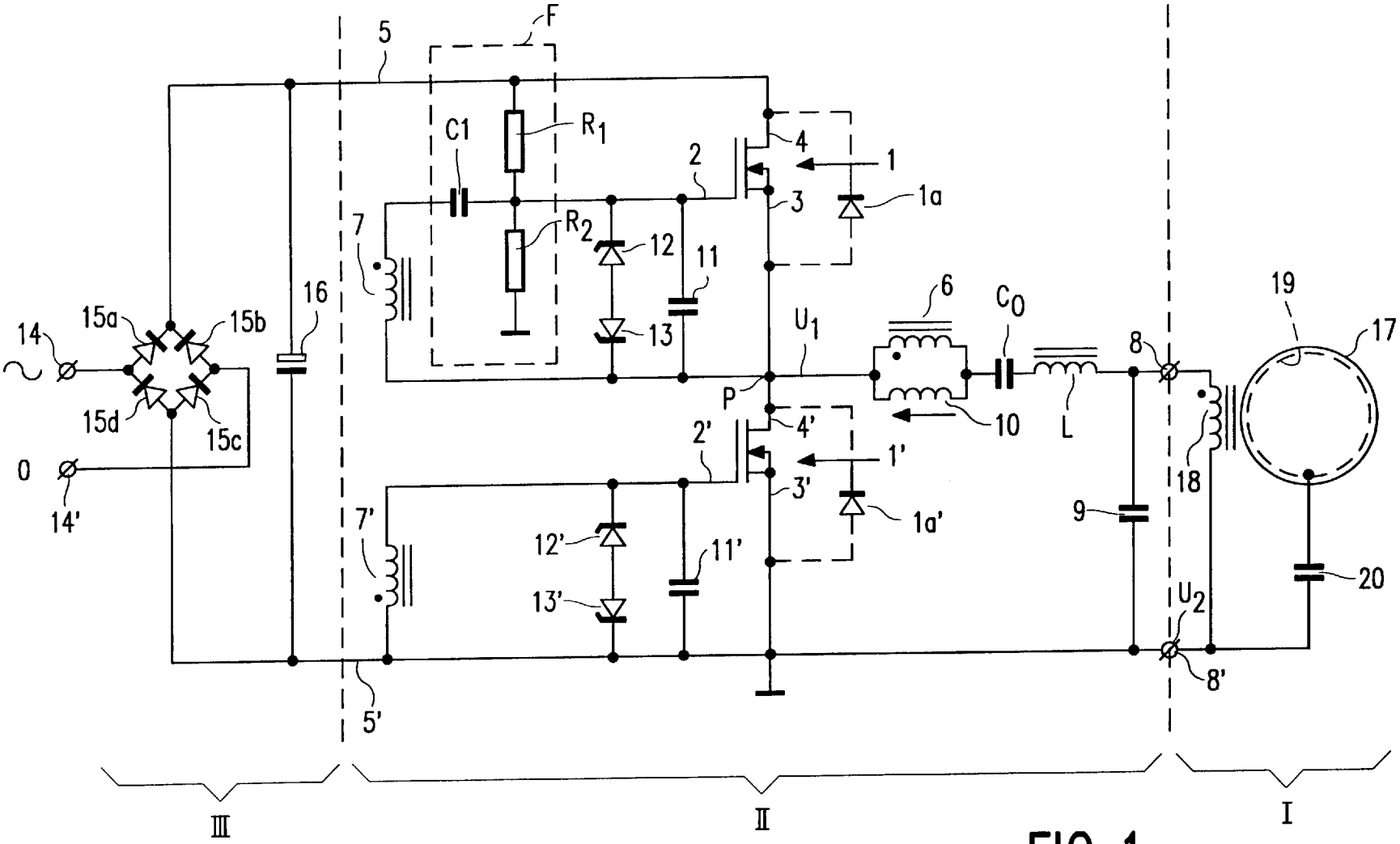
FIGS. 1 and 2 show a first and a second embodiment, respectively.

FIG. 1 shows a circuit arrangement for operating a discharge lamp I. The circuit arrangement comprises a DC/AC converter II provided with a series arrangement A of a first and a second switching element 1, 1' between a first and a second input terminal 5, 5' for connection to a DC voltage source III. The switching elements 1, 1' each have a control electrode 2, 2', a main electrode 3, 3', and a further main electrode 4, 4'. The DC/AC converter is in addition provided with a load branch B which comprises in that order a primary winding 6 of a transformer, decoupling capacitive means Co, inductive means L, and output terminals 8, 8' for connecting the lamp I. In an alternative embodiment, the inductive means are integral with the primary winding of the transformer. The load branch in the circuit arrangement of FIG. 1 in addition has a capacitor 9 which shunts the output terminals 8, 8' and a coil 10 with a variable self-inductance which shunts the primary winding 6 of the transformer. The load branch B has a first end U1 which is connected to a junction point P situated in the series arrangement A and a second end U2, formed by output terminal 8', which is connected to an input terminal 5'. Between the control electrode 2 and the main electrode 3 of the first switching element 1 there is a first secondary winding 7 of the transformer. A second secondary winding 7' of the transformer is arranged between the control electrode 2' and the main electrode 3' of the second switching element 1'. A capacitor 11 interconnects the control electrode 2 and the main electrode 3 of the first switching element 1. The capacitor 11 is shunted by a series arrangement of two zener diodes 12, 13 which are connected in mutually opposed directions. Similarly, a capacitor 11' and zener diodes 12', 13' are included between the control electrode 2' and the main electrode 3' of the second switching element 1'.

First resistive means R1 between the first input terminal 5 and the control electrode 2 of the first switching element 1 form part of a starting circuit F. The starting circuit F further comprises first capacitive means C1 which are arranged in series with the first secondary winding 7 between the control electrode 2 and the main electrode 3 of the first switching element 1.

The circuit arrangement has the characteristic that the DC/AC converter is provided with second resistive means R2 which together with the first resistive means R1 form a voltage divider between the input terminals 5, 5'.

In the circuit shown in FIG. 1, the input terminals 5, 5' of the DC/AC converter II are connected to a DC voltage source III with input terminals 14, 14' for connection to an AC voltage source. The DC voltage source III comprises a diode bridge 15*a*–15*d* for rectifying the voltage supplied by the AC voltage source and a smoothing capacitor 16. The DC voltage source III may comprise additional means, for example means for suppressing high-frequency mains interferences and for improving the power factor of the circuit arrangement.

FIG. 1 in addition diagrammatically shows an electrodeless lamp I with a discharge vessel 17 and a coil 18 for generating an alternating magnetic field in the discharge vessel. The coil 18 is connected to the output terminals 8, 8' of the load branch. The discharge vessel 17 has a transparent conductive layer 19 at an inner surface, which layer is connected to one of the output terminals 8' via a capacitor 20.

The circuit shown in FIG. 1 operates as follows. When the DC voltage source III is connected to an AC voltage source, the capacitor 16 is charged via the diode bridge 15*a*–15*d* to close to the top value of the AC voltage of the AC voltage source. The voltage across the input terminals 5, 5' is present across the series arrangement of the first and second resistive means R1, R2. The first capacitive means C1 and capacitor 11 are charged through the voltage divider R1, R2 formed by this series arrangement. This results in a voltage higher than the threshold voltage between the control electrode 2 and the main electrode 3 of the first switching element 1. The switching element 1 as a result enters the conductive state, so that a current starts to flow through the switching element 1 and the primary winding 6 of the transformer. The decoupling capacitive means Co are charged by this. Owing to the current through the primary winding 6 of the transformer, a voltage arises in the first secondary winding 7 of the transformer which renders the switching element 1 non-conducting. At the same time, a voltage arises in the second secondary winding 7' which renders the switching element 1' conducting, so that the current through the primary winding 6 of the transformer in the load branch decreases. This current strength fluctuation generates voltages in the secondary windings 7, 7' which bring the switching elements 1 and 1' into a conductive and a non-conductive state again, respectively, so that the DC/AC converter starts a new cycle of its oscillation. The average value of the half bridge voltage is maintained at a level approximately equal to the reference level set by the voltage divider R1, R2 during nominal operation of the DC/AC converter. The switching elements 1, 1' as a result approximately have the same periods of conduction, so that the switching losses are comparatively low.

In a practical implementation, the first capacitive means C1 are formed by a capacitor with a value of 100 nF. A 10 nF capacitor forms the decoupling capacitive means Co. The capacitors 11 and 11' each have a value of 2.2 nF. The capacitors 9, 16 and 20 have values of 0.5 nF, 10 $\mu$F and 4.6 nF, respectively. The inductive means L in said implementation are formed by a coil with a self-inductance of 33 $\mu$H. The coil 10 with variable self-inductance has a maximum value of 310 nH, and coil 18 for generating a high-frequency magnetic field in the discharge vessel 17 of the lamp I has a self-inductance of 9.7 $\mu$H. The first resistive means R1 and the second resistive means R2 in this implementation are each formed by a resistor of 4.7 MΩ. MOSFETs of the IRFU420 type form the switching elements 1, 1'. Freewheel diodes 1*a*, 1*a'* integral therewith are shown in broken lines in the drawing. The diodes 15*a*–15*d* are of the U05J4B48 type. The zener diodes 12, 13, 12', 13' have a breakdown voltage of 15 V. The transformer has a toroidal core, and the windings 6, 7, 7' each have 5 turns.

Figure 2:
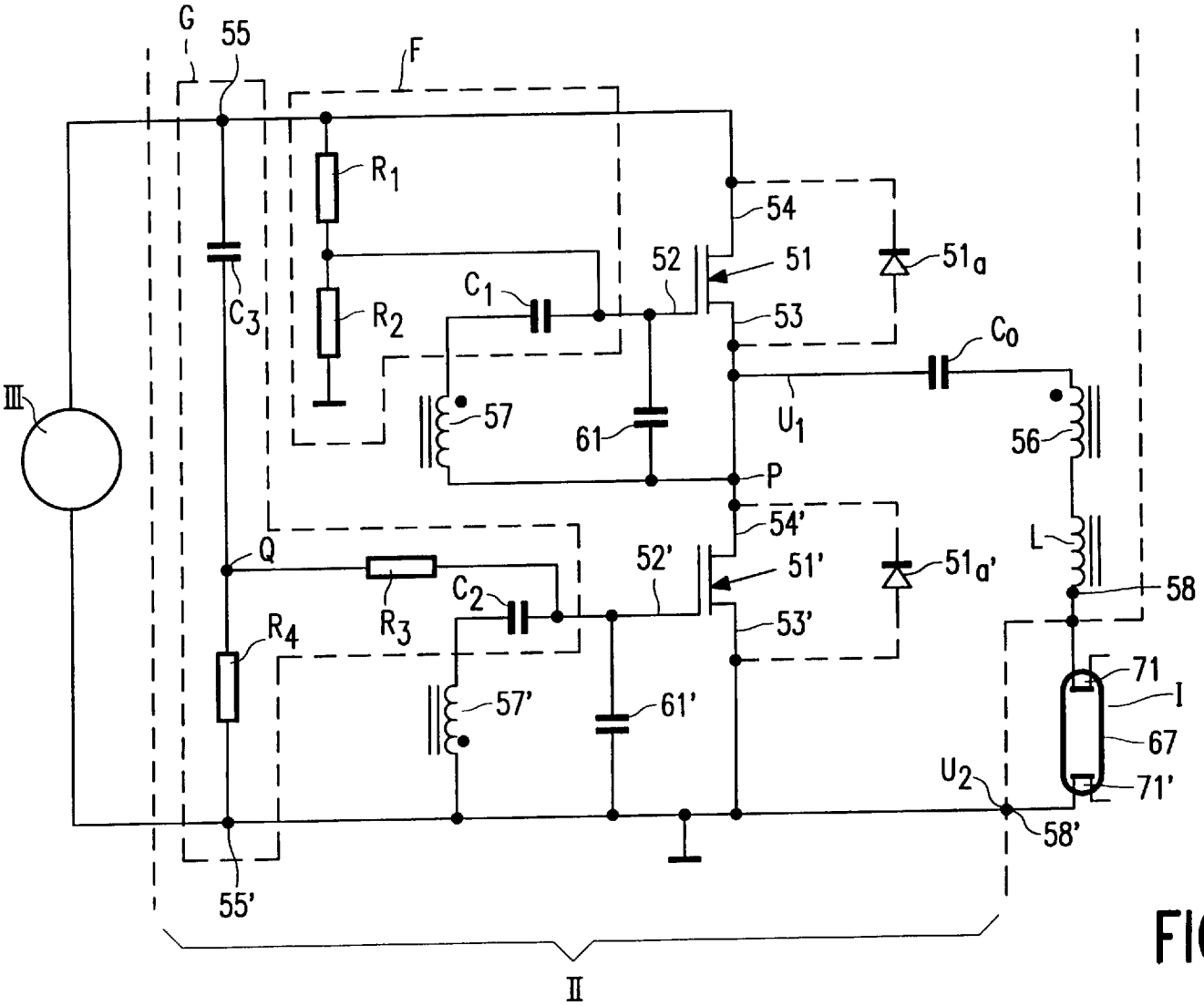

A second embodiment of the DC/AC converter according to the invention is shown in FIG. 2. Components therein corresponding to those of FIG. 1 have reference numerals which are 50 higher. Second capacitive means C2 are connected in series with the second secondary winding 57' of the transformer in this embodiment, between the control electrode 52' and a main electrode 53' of the second switching element 51'. Third and fourth resistive means R3, R4 form a series circuit between the control electrode 52' and said main electrode 53' of the second switching element 51'. A common junction point Q of the third and fourth resistive means R3, R4 is connected to the first input terminal 55 via third capacitive means C3.

The second and third capacitive means C2, C3 and the third and fourth resistive means R3, R4 together form means G for offering a voltage pulse to the control electrode 52' of the second switching element 51' after switching-on of the circuit arrangement so as to have said switching element temporarily assume a conductive state.

The DC/AC converter is used for operating a low-pressure mercury discharge lamp I with a discharge vessel 67, for which purpose electrodes 71, 71' of the lamp are connected to the output terminals 58, 58' of the DC/AC converter.

The circuit shown in FIG. 2 operates as follows. After the DC voltage source III to which the DC/AC converter II is connected has been switched on, a voltage arises at point Q which shows a gradual temporal gradient from the voltage at the first input terminal 55 up to that at the second input terminal 55'. The capacitor 61' and the second capacitive means C2 are charged by this voltage via the third resistive means R3. The second switching element 51' as a result also enters a conductive state approximately simultaneously with the first switching element 51, so that the current through the first switching element 51 can drain off partly through the second switching element 51'. Since the third capacitive means C3 are charged, the average control voltage between the electrodes 52' and 53' drops to zero again, and the means G have no influence any more on the operation of the second switching element 51' during nominal operation of the circuit arrangement.

In a practical implementation, the first capacitive means C1 are formed by a capacitor with a value of 47 nF. A capacitor of 100 nF forms the decoupling capacitive means Co. The capacitors 61 and 61' each have a value of 2.2 nF. The inductive means L in said implementation are formed by a coil with a self-inductance of 1.5 nH. The first resistive means R1 and the second resistive means R2 in this implementation are each formed by a resistor of 4.7 MΩ. The third resistive means R3 and the fourth resistive means R4 are formed by resistors of 4.7MΩ and 10 MΩ, respectively. The second capacitive means C2 and the third capacitive means C3 are both formed by a capacitor of 47 nF here. MOSFETs of the IRFU420 type form the switching elements 51, 51'. Freewheel diodes 51*a*, 51*a'* integral therewith have been indicated with broken lines in the drawing. The transformer has a toroidal core and the windings 56, 57, 57' have six turns each.

We claim:

1. A DC/AC converter for operating a discharge lamp from a DC source, comprising:

an input adapted to be coupled to the DC source and an output adapted to be coupled to the lamp;

a series arrangement of a first and a second switching element coupled to the input of the converter, the switching elements each having a control electrode and a main electrode;

a load branch including at least a primary winding of a transformer and inductive means, the load branch being coupled to the series arrangement and the output of the converter;

a first and a second secondary winding of the transformer coupled between the control electrode of the first switching element and the main electrode of the second switching element; and a starting circuit including first resistive means coupled to the input of the converter and to the control electrode of the first switching element, first capacitive means coupled in series with the first secondary winding, both being coupled between the control electrode and the main electrode of the first switching element, and second resistive means coupled to the first resistive means to form a voltage divider coupled to the input of the converter.

2. The DC/AC converter as claimed in claim 1, further including means for offering a voltage pulse between the control electrode and the main electrode of the second switching element after switching-on of the converter so as to have the second switching element temporarily assume a conductive state.

3. The DC/AC converter as claimed in claim 1, wherein the primary winding of the transformer is coupled in series with the output of the converter.

4. The DC/AC converter as claimed in claim 1, further including second capacitance means coupled between the control and main electrodes of the second switching element.

5. A DC/AC converter for operating a discharge lamp from a DC source, comprising:

input means coupled to the DC source;

output means coupled to the discharge lamp;

first means for switching having a respective control electrode and a main electrode;

second means for switching serially coupled to said first switching means at a common node and having a respective control electrode and a main electrode;

a load branch, electrically coupled to said first and said second switching means at said common node, comprising:

a primary winding of a transformer; and inductive means, first secondary winding means of the transformer coupled between the control electrode and the main electrode of said first switching means;

second secondary winding means of the transformer coupled between the control and the main electrode of said second switching means; and starting means, comprising first resistive means coupled to said input means and to the control electrode of the first switching element;

first capacitive means serially coupling said first secondary winding means to said common node; and second resistive means coupled to the first resistive means to form a voltage divider coupled to said input means.

6. The DC/AC converter as claimed in claim 5, further including means for offering a voltage pulse between the control electrode and the main electrode of the second switching means after switching-on of the converter so as to have the second switching means temporarily assume a conductive state.

7. The DC/AC converter as claimed in claim 6, wherein said offering means comprises second and third capacitive means and third and fourth resistive means, the second capacitive means being included in series with the second secondary winding means between the control electrode and the main electrode of said second switching means, and the third and fourth resistive means forming a series circuit between the control electrode and the main electrode of said second switching means, a common junction point of the third and fourth resistive means being coupled to said input means via the third capacitive means.

8. The DC/AC converter as claimed in claim 5, wherein the primary winding of the transformer is coupled in series with the output of the converter.

9. The DC/AC converter as claimed in claim 5, further including second capacitance means coupled between the control and main electrodes of said second switching element.

10. A DC/AC converter for operating a discharge lamp from a DC source, comprising:

an input adapted to be coupled to the DC source and an output adapted to be coupled to the lamp;

a series arrangement of a first and a second switching element coupled to the input of the converter, the switching elements each having a control electrode and a main electrode;

a load branch including at least a primary winding of a transformer and inductive means, the load branch being coupled to the series arrangement and the output of the converter;

a first and a second secondary winding of the transformer coupled between the control electrode of the first switching element and the main electrode of the second switching element;

a starting circuit including first resistive means coupled to the input of the converter and to the control electrode of the first switching element, first capacitive means coupled in series with the first secondary winding between the control electrode and the main electrode of the first switching element, and second resistive means coupled to the first resistive means to form a voltage divider coupled to the input of the converter;

means for offering a voltage pulse between the control electrode and the main electrode of the second switching element after switching-on of the converter so as to have the second switching element temporarily assume a conductive state, wherein the means for offering the voltage pulse comprise second and third capacitive means and third and fourth resistive means, the second capacitive means being included in series with the second secondary winding of the transformer between the control electrode and the main electrode of the second switching element, and the third and fourth resistive means forming a series circuit between the control electrode and the main electrode of the second switching element, a common junction point of the third and fourth resistive means being coupled to the input of the converter via the third capacitive means.

11. The DC/AC converter as claimed in claim 10, wherein the primary winding of the transformer is coupled in series with the output of the converter.

12. The DC/AC converter as claimed in claim 10, further including fourth capacitance means coupled between the control and main electrodes of the first switching element.

* * * * *